US005864904A

United States Patent [19]

Rudick

[11] Patent Number: 5,864,904

[45] Date of Patent: Feb. 2, 1999

[54] BED PILLOW

[76] Inventor: Maly Rudick, 9775 NW. 49 Ter., Miami, Fla. 33178

[21] Appl. No.: 5,021

[22] Filed: Jan. 9, 1998

[51] Int. Cl.[6] ..... A47G 9/00

[52] U.S. Cl. ..... 5/640; 5/636; 5/490; 5/638

[58] Field of Search ..... 5/640, 636, 638, 5/644, 490, 655; D6/601

[56] References Cited

U.S. PATENT DOCUMENTS

| | | | |
|---|---|---|---|
| D. 176,758 | 1/1956 | Edmonson . | |
| 2,577,595 | 12/1951 | Tobias . | |
| 2,667,915 | 2/1954 | Pfeffer . | |
| 2,765,480 | 10/1956 | Mueller . | |
| 2,810,920 | 10/1957 | Carruth | 5/638 |
| 2,952,856 | 9/1960 | Ruff | 5/640 |
| 4,042,278 | 8/1977 | Jenson | 297/397 |
| 4,274,673 | 6/1981 | Kifferstein . | |
| 4,345,345 | 8/1982 | Holtz | 5/640 |
| 4,550,458 | 11/1985 | Fiore | 297/393 |
| 4,776,049 | 10/1988 | Perron | 5/640 |
| 4,780,920 | 11/1988 | White | 5/490 |

FOREIGN PATENT DOCUMENTS

| | | | |
|---|---|---|---|
| 782695 | 6/1935 | France | 5/640 |
| 2527 | of 1911 | United Kingdom | 5/645 |
| 14561 | of 1913 | United Kingdom | 5/640 |
| 2130085 | 5/1984 | United Kingdom | 5/636 |
| 2194883 | 3/1988 | United Kingdom | 5/640 |

*Primary Examiner*—Alex Grosz
*Attorney, Agent, or Firm*—Richard C. Litman

[57] ABSTRACT

A sectioned pillow having two pillow covers, which are connected by a fabric tether, inner pillows, and a decorative pillow case for each of the tethered inner pillow covers. The tether prevents separation of the two pillows beyond a predetermined maximum distance. The space created between the two pillows provides a cradle for the head in a supine sleeping position. In a prone sleeping position, the space between the two pillows acts as an air channel allowing for the free flow of air to and from the sleeper's nose.

4 Claims, 4 Drawing Sheets

BED PILLOW

BACKGROUND OF THE INVENTION

1. Field of the Invention

The present invention relates to pillows. More specifically, the present invention relates to a bipartite bed pillow assembly having mutipositional uses for aiding sleep.

2. Description of the Related Art

Sleeping habits, good and bad, are developed as children. When we are younger, however, our bodies are more recuperative, and do not feel the effects of poor or improper sleeping positions. As we age, our bodies are more susceptible to these effects. For this reason, optimal sleeping positions have been researched. Many people are comfortable lying on their backs, but find that in this position their heads roll, uncomfortably, from side to side often leading to cramped necks in the morning. Others would benefit from sound deadening effects in this position.

A great many people enjoy sleeping on their stomachs, in a prone position. The obvious drawback is that either one's nose is buried in a pillow, or head is turned uncomfortably to one side in order to breathe freely. Once again this leads to neck strains and pains in the morning. This also leads to discomfort during the night which, although the sleeper may be unaware, disturbs sleep. A prone sleeping position allows for alignment of the head, neck, and spine when the head is not turned to one side. Sleeping in such a position is impossible on standard and many therapeutic pillows. A pillow is therefore needed that will allow the sleeper to place his or her head in alignment with the neck and spine while leaving an air passage open to the nose for proper breathing.

Since few people sleep in the same position every day, it is beneficial to have a pillow that may adjust to several different sleeping styles, including the face down prone position. Another advantage sought is aesthetic appeal. Typical therapeutic pillows on the market today are not worthy of being placed atop a modern bed. Funny shapes and awkward materials make most of these pillows unsightly accompaniments in an otherwise pleasant sleeping area.

Pillows and headrests for aiding sleep or rest have been the subject of earlier patents. Some examples of these include U.S. Pat. No. Des. 176,758, which issued to Edmonson on Jan. 31, 1956, disclosing a headrest made of two cushions connected by a sheet of fabric having essentially the same vertical dimension of the cushions.

U.S. Pat. No. 2,765,480, which issued to Mueller on Oct. 9, 1956, discloses an all purpose orthopedic pillow. The inventions includes two cushions separated by a sheet of fabric, having the same width dimension as the cushions.

Another pillow of this type, having a sheet equivalent in length to the cushions is disclosed in U.S. Pat. No. 4,274,673, which issued to Kifferstein on Jun. 23, 1981. That patent discloses a disposable adjustable headrest and pillow. Cushions may be added or removed to either side of the pillow depending upon need.

U.S. Pat. No. 2,577,595, which issued to Tobias on Dec. 4, 1951, discloses an articulated pillow and case. The pillow has a large upper horizontal section, and a lower horizontal section. The pillow further provides an articulating portion that may be rotated ninety degrees to support a shoulder raising the sleeper slightly to one side. A pillow case designed for the pillow is also disclosed.

U.S. Pat. No. 4,042,278, which issued to Jenson on Aug. 16, 1977, discloses a drowsing chair pillow designed to hang over the back of a chair, positioning raised cushions on either side of the head to prevent the head from rocking from side to side.

U.S. Pat. No. 4,550,458, which issued to Fiore on Nov. 5, 1985, discloses a cervical support pillow. The pillow has a generally semicircular cutout portion extending from the top edge to a central portion of the pillow. The pillow is designed to support the neck and head while resting or sleeping in a variety of positions, including a prone position with the face pointing partially downward.

British patent document no. 2527, dated May 18, 1911, discloses a pillow having two horizontal sections connected by a horizontal recessed area travelling the length of the pillow.

Other pillow designs have been the subject of earlier patents, but are less related to the present invention. Among these are U.S. Pat. No. 4,780,920 (angular sleeper's pillow and pillowcase) which issued to White on Nov. 1, 1988; and U.S. Pat. No. 2,667,915 (pillow) which issued to Pfeffer et al. on Nov. 21, 1949.

Despite these previous efforts, there is still a need for a bed pillow that accommodates all sleeping positions, including a face down prone position, while being aesthetically pleasing enough to keep on the bed when not in use.

None of the above inventions and patents, taken either singularly or in combination, is seen to describe the instant invention as claimed. Thus a sectioned pillow solving the aforementioned problems is desired.

SUMMARY OF THE INVENTION

The present invention is a sectioned bed pillow. The bed pillow is made up of two pillow covers, which are connected by a fabric tether. Inside each cover is at least one pillow. Finally, a decorative pillow case finishes the pillow so that it may fit any decor and be left on top of the bed. The tether prevents separation of the two pillows beyond a predetermined maximum distance. The space created between the two pillows has many uses. In a supine sleeping position, the space may be used to cradle the head to allow the head to rest on the bed below while the pillows block sound. In a prone sleeping position, the space between the two pillows allows the sleeper to place his nose in the space for free breathing. In any case, the pillow of the invention helps promote restful sleep.

Accordingly, it is a principal object of the invention to provide a bed pillow that accommodates a face down prone sleeping position with free air flow to the nose.

It is another object of the invention to provide a bed pillow that will allow sleep in several different positions with various benefits.

It is a further object of the invention to be aesthetically pleasing in a bedroom environment.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
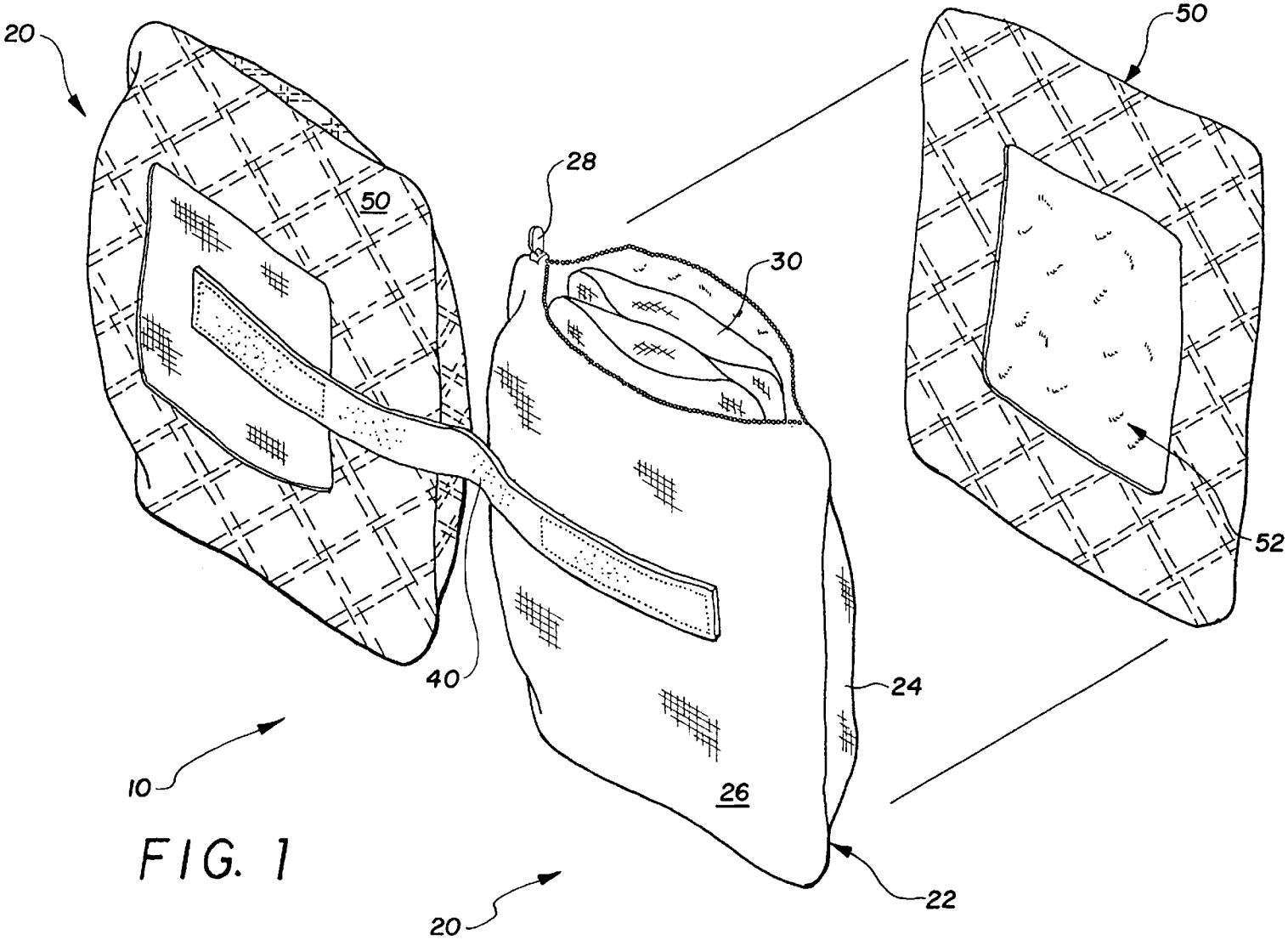
FIG. 1 is a rear, partially exploded, perspective view of a sectioned bed pillow according to the present invention.

Referring now to the figures by numerals of reference, a sectioned bed pillow 10 of the present invention is shown. FIG. 1 shows the bed pillow 10 and its parts. The bed pillow 10 is made up of two pillows 20 each having a pillow cover 22. The pillows 20 are connected by a fabric tether 40 attached to each cover 22. Inside each cover 22 is at least one inner pillow 30. Finally, a decorative pillow case 50 finishes the pillow so that it may fit any decor and be left on top of the bed.

Each pillow cover 22 is made from two rectangular sheets of fabric. An upper sheet 24 and a lower sheet 26 are attached on three sides to define an interior cavity. The fourth side is provided with a zipper 28 for access to the interior cavity. The covers 22 may be made from any suitable material. The pillow covers 22 may also be made of various sizes to accommodate various types of pillows.

The pillow covers 22 are connected to each other by a fabric tether 40. The tether 40 is relatively narrow when compared to the size of the pillows 20 and preferably not more than two and three eights inches wide. This is to prevent bunching of the tether 40 when the pillows 20 are moved in use, which would defeat the usefulness of the bed pillow 10. If bunching were to occur, it could interfere with proper breathing or comfort, depending upon the sleeping position as discussed below. The tether 40 is attached at the midpoint of each pillow cover 22 on its lower side 26. When the pillow covers 22 are filled, the tether 40 prevents the pillows 20 from separating beyond a predetermined distance, preferably about one and one half inches.

Each pillow cover 22 is filled with at least one inner pillow 30. This forms two separate pillows 20 that are attached by the tether 40. These inner pillows 30 must be firm enough to support a sleeper's head during the night. Pillows that envelop the head in cushioned softness may be too soft for the purposes of the present invention. Multiple pillows may be used stuffed into each cover 22 to achieve the desired firmness.

Finally, a decorative pillow case 50 is used to envelop each filled pillow cover 22. Because of the attached tether 40, a standard pillow case cannot be used to encase the pillow cover 22. Each case 50 includes an outer sheet and an inner sheet attached to each other at all four sides. The outer sheet is preferably decorative. The inner sheet defines an opening 52. The opening 52 is of sufficient size to allow a filled pillow cover 22 to be stuffed into the case 50. The opening 52 also allows the tether 40 to pass therethrough. In this manner, the opening 52 and tether 40 may be placed out of view, with only the decorative outer sheet being visible from a distance.

Figure 2:
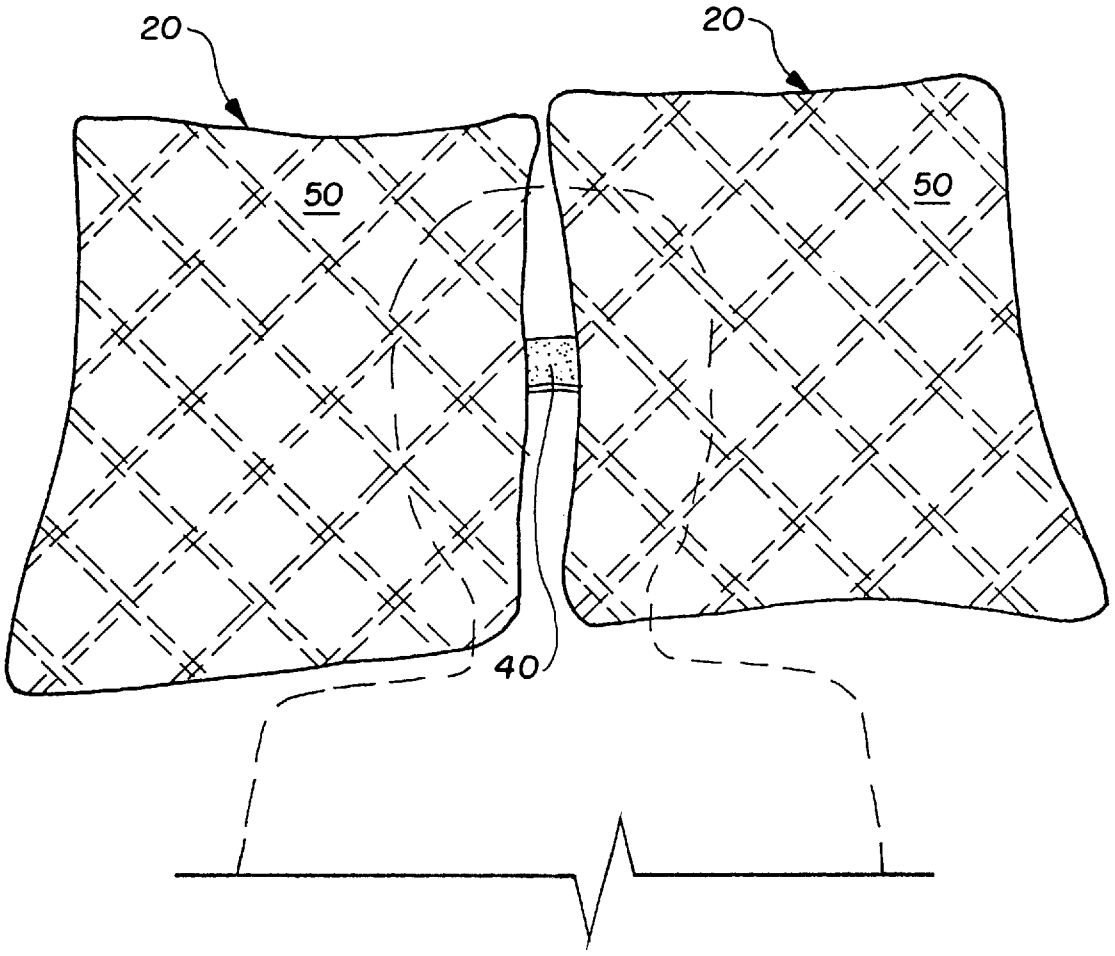
FIG. 2 is a plan view of the sectioned bed pillow with sleeper, shown in phantom, in a supine position.

FIG. 2 shows one use of the present invention. The user may sleep in a supine position, on his back, placing the head on a portion of each of the pillows 20 but resting in between both pillows 20. In this position, the head rests in the gap between each pillow 20, but is cradled firmly by the pillows 20. In this fashion, the head is discouraged from moving from side to side, thus keeping the head, neck and spine in alignment.

Figure 3:
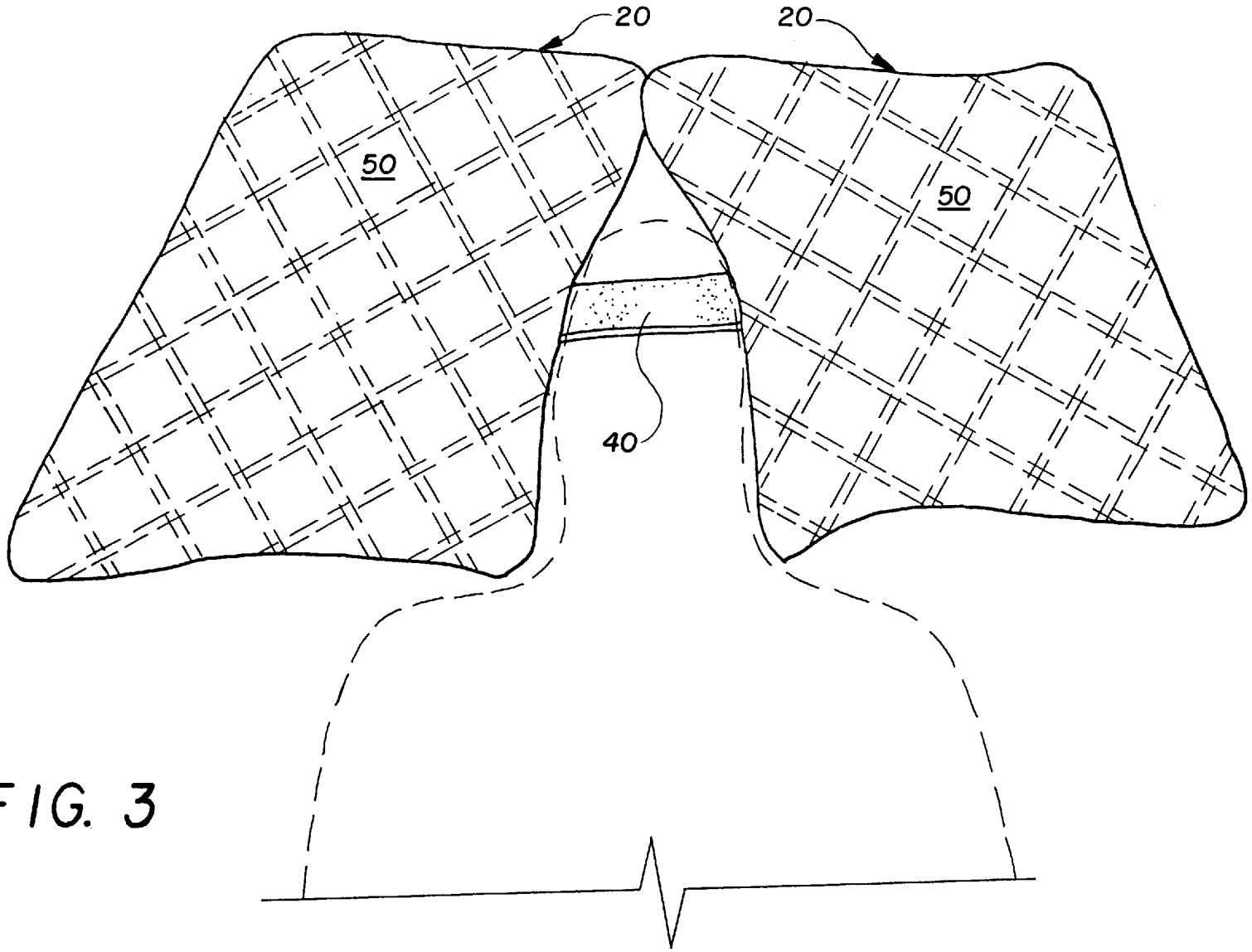
FIG. 3 is a plan view of the sectioned bed pillow with sleeper, in phantom, in a supine position with pillow blocking sound.

FIG. 3 also shows a supine sleeping position. In this case, the pillows 20 are joined at the central upper corners and separated at the lower corners. The sleeper places his head between the two pillows 20 on the bed. In this manner, the sleeper's head is resting on the bed, while being discouraged from side movement by the pillows 20 on either side. This use has the added benefit of protecting the sleeping user from outside noises, since the ears are covered by the pillows. This positioning of the pillows 20 is permitted by virtue of the reduced width of the strap, freeing the upper and lower corners of the pillows to be moved.

Figure 4:
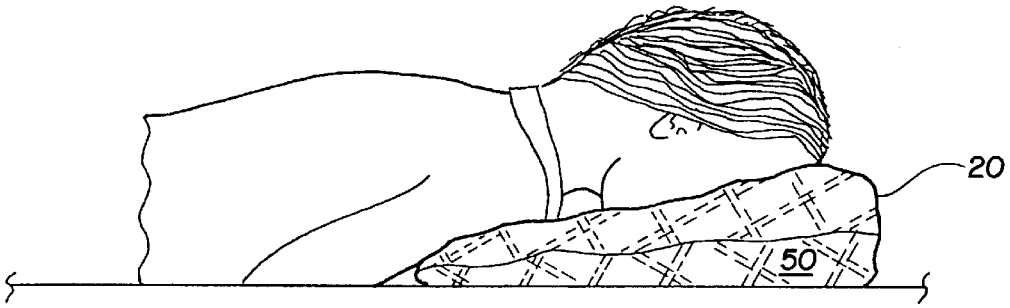
FIG. 4 is a side view of the sectioned bed pillow in use in a prone sleeping position.
Figure 5:
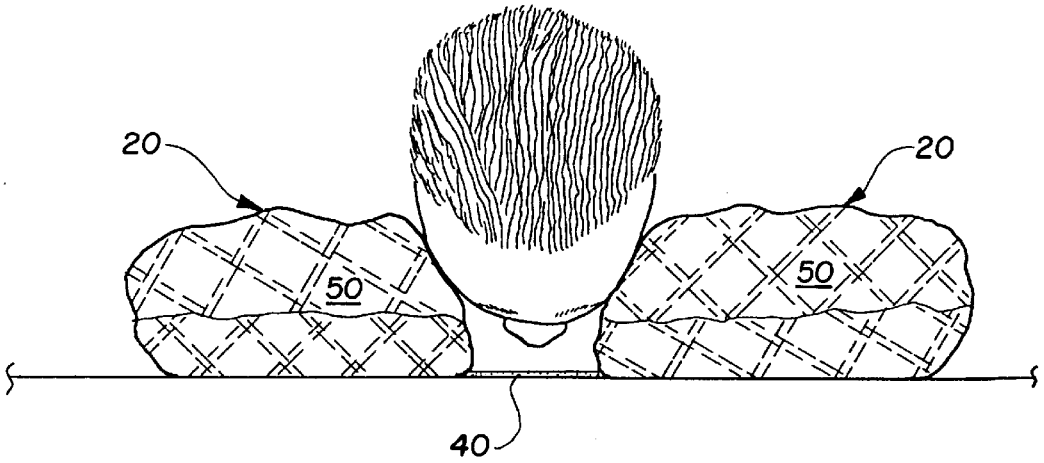
FIG. 5 is a front view of the sectioned bed pillow in use in a prone sleeping position.

FIGS. 4 and 5 show the most preferred use of the present invention. The user is allowed to sleep in a prone position with face straight downward. This position allows for greater alignment of the head, neck and spine. This position has heretofore been impossible since the nose is normally buried in the pillow, necessitating the turning of the sleeper's head. As shown in these figures, the pillows 20 are separated, parallel to each other. This forms a central channel between the pillows which ultimately allows free circulation of air to and from the nostrils. This is why the firmness of the pillows is important. The pillows 20 must be firm enough to support the head with nose above the bed surface. In this position, the sleeper's shoulders are placed on the lower portion of each pillow, while the head is placed at the upper portion of the pillow 20 with the nose in between the two pillows. The pillows 20 may be moved inward or outward, to the maximum distance, to adjust the ultimate height of the nose above the bed surface. The inventor has found that sleep in this position alleviates the need for extensive morning stretching.

It is to be understood that the present invention is not limited to the embodiments described above, but encompasses any and all embodiments within the scope of the following claims.

I claim:

1. A bed pillow comprising:

a first inner rectangular pillow cover defined by an upper sheet having a four sides, said upper sheet attached on three sides to a lower sheet to define an interior cavity, said lower sheet having a midpoint, said cover also having a zipper closure on the fourth side to provide access to said cavity;

a second inner rectangular pillow cover identical to the first inner rectangular pillow cover;

firm inner pillows inserted into each of said pillow covers;

a fabric tether attached to said first inner pillow cover and said second inner pillow cover substantially along the midpoint of each lower sheet such that said first inner pillow cover and said second inner pillow cover are separated by a maximum distance of approximately one and a half inches when filled, said tether having a relatively narrow width when compared to said pillow covers for allowing independent movement of said pillows.

2. The bed pillow as defined by claim 1 wherein said tether is sufficiently narrow to prevent bunching of said tether when pillows are moved.

3. The bed pillow as defined by claim 2, wherein said tether is approximately 2⅜ inches wide.

4. The bed pillow as defined by claim 1 wherein said pillow further comprises a pair of outer rectangular pillow cases, each for receiving one of said inner rectangular pillow covers, each having an opening through which said filled pillow covers are inserted, while allowing said tether to exit freely through said opening.

* * * * *